United States Patent [19]

Coon, Jr.

[11] Patent Number: 4,470,587

[45] Date of Patent: Sep. 11, 1984

[54] PAPER INSERT APPARATUS WITH RECIPROCATING PUSHER CONVEYER

[76] Inventor: James O. Coon, Jr., 256 W. Highway 98, Apalachicola, Fla. 32320

[21] Appl. No.: 388,902

[22] Filed: Jun. 16, 1982

[51] Int. Cl.[3] ..... B65H 5/30

[52] U.S. Cl. ..... 270/55

[58] Field of Search ..... 270/55, 57-58; 271/280-281, 9, 10, 14, 23, 33, 35, 117, 118, 119, 131, 138, 42

[56] References Cited

U.S. PATENT DOCUMENTS

| | | | |
|---|---|---|---|
| 1,177,524 | 3/1916 | Kast | 270/55 |
| 1,659,099 | 2/1928 | Halvorsen | 270/55 |
| 1,883,307 | 10/1932 | Livingston et al. | 270/55 |
| 1,951,300 | 3/1934 | Zimmer | 270/55 |
| 2,892,627 | 6/1959 | Newhouse | 270/55 |
| 4,174,829 | 11/1979 | McCain et al. | 270/55 |
| 4,373,710 | 2/1983 | Hansen et al. | 270/55 |
| 4,420,146 | 12/1983 | Reist | 270/55 |

FOREIGN PATENT DOCUMENTS

| | | | |
|---|---|---|---|
| 358444 | 1/1962 | Switzerland | 270/57 |

*Primary Examiner*—E. H. Eickholt

[57] ABSTRACT

The present invention is an apparatus for inserting printed material into a newspaper or the like. A first separating unit is provided for a stack of newspapers, referred to as jackets. A jacket is separated from the stack and pushed forward onto an insert unit on a slightly lower level. A second separating unit contains a stack of insert material, one insert at a time being separated and pushed forward. The jacket is moved laterally in front of the second separating unit and is opened by an opening blade. The insert is pushed forward into the open jacket which is pushed away from the opening blade permitting closure by gravity. A plurality of successive separating units may be provided for multiple inserts.

12 Claims, 11 Drawing Figures

PAPER INSERT APPARATUS WITH RECIPROCATING PUSHER CONVEYER

BACKGROUND OF THE INVENTION

The present invention relates to apparatus for inserting papers into a jacket, and more particularly to a low-cost, low-volume machine for placing inserts into newspapers and the like.

The current publishing market has an unmet need for a machine to insert materials into a newspaper or the like which is both inexpensive and simple in its construction and operation. This need is met, however, by the present invention. This new apparatus, unlike the insert machines which are now on the market, is designed to be used by businesses which do not have the financial means to purchase and maintain the more complex paper insert machines.

The new paper insert machine has some major advantages over the existing models. First, the initial cash outlay to procure this present invention is substantially less than the initial costs of the available insert machines. Second, the present paper insert apparatus was designed to operate at less than 10,000 papers per hour which would allow one person to operate the machine. Generally, the larger, high-speed insert machines require a full crew of individuals to keep the machine operational.

Another major advantage of the new paper insert apparatus is that no support equipment is necessary for the machine's operation. This eliminates the cost of purchasing and maintaining equipment such as vacuum pumps, compressors and electronic control systems; these are normally required for the larger units.

Finally, the present invention considerably reduces the number of machine adjustments that a publisher needs to make. Often a publisher does not have the tehcnical expertise to make the adjustments himself or does not have the financial means to hire someone to make the necessary adjustments.

SUMMARY OF THE INVENTION

The new paper insert machine fills a gap that has existed in the insert machine business for a number of years. This invention differs from other machines in that it is both simple in its design and operation and it also provides an inexpensive alternative to the currently available models.

The present invention is best described as an efficient combination of two units—the separating unit and the insert unit. Stacks of material to be inserted are first placed into various separating units which hold the material, each unit having a three-sided compartment. The number of separating units to be used only depends on the number of inserts desired. The separating units, with the exception of the unit containing the material to be used as a jacket, are placed side-by-side all facing in the same direction. These separating units have a carriage mechanism which separates the bottom piece of material from each stack and places it in front of the compartment which holds the stacks; subsequently, the mechanism pushes the mateial into an insert unit.

The single insert unit is perpendicular to and lower in height than the separating units. The length of the insert unit is slightly longer than the sum of the lengths all of the separating units plus a space between the separating units holding the jacket and the ones containing the inserts. The function of the insert unit is to open the jacket by means of paper pushers, paper holders, and a blade opening. This allows an insert to be placed in the jacket as the material is carried down the insert unit and momentarily stops in front of each separating unit. At the conclusion of the material's traverse down the press insert machine, the jacket is closed by the force of gravity as the package leaves the edge of the machine.

DETAILED DESCRIPTION OF THE PREFERRED EMBODIMENT

Figure 1:
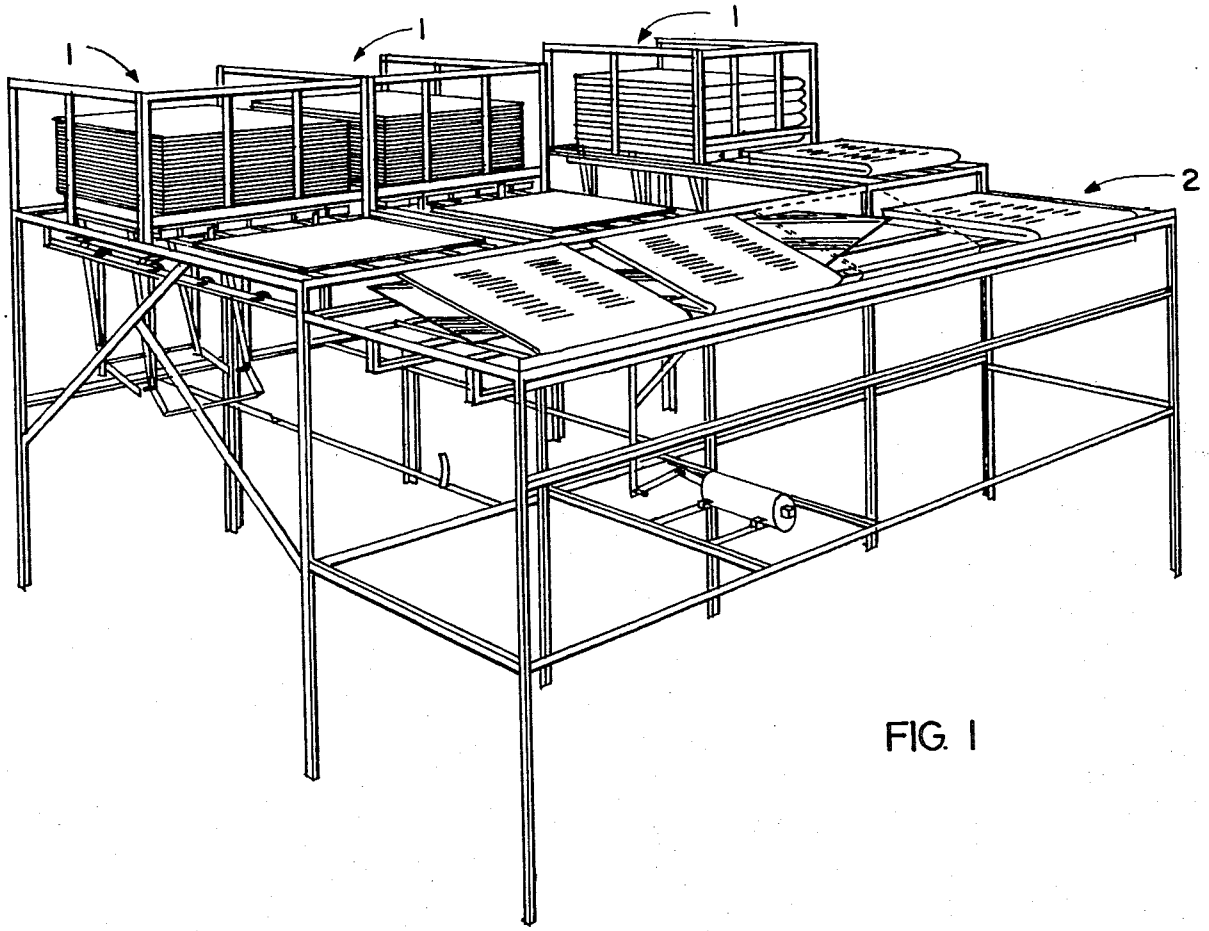
FIG. 1 is a perspective view of a complete machine showing the general form of the machine.

FIG. 1 shows a perspective view of the paper insert apparatus of the invention having an inserting unit 2 and a plurality of separating units 1. As shown, two separating units 1 on the left side of frame 2 hold a stack of insert material while the separating unit 1 on the right holds a stack of newspapers or other material. A newspaper into which the insert material will be inserted will be referred to as a jacket.

Figure 2:
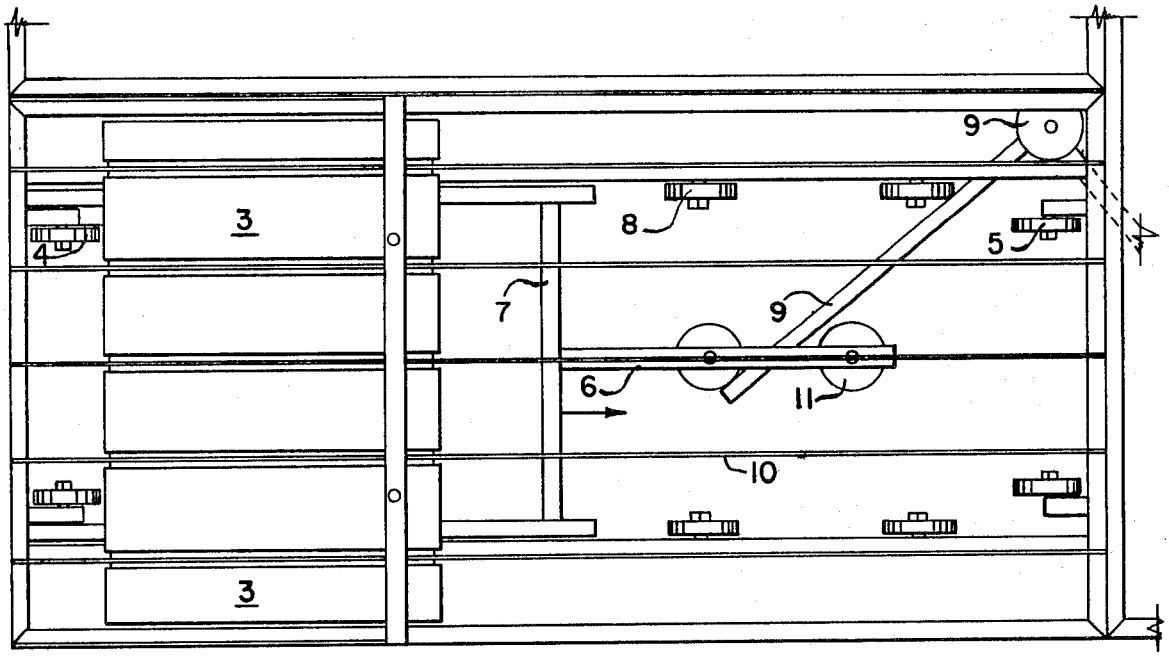
FIG. 2 is a top view of a complete separating unit.
Figure 3:
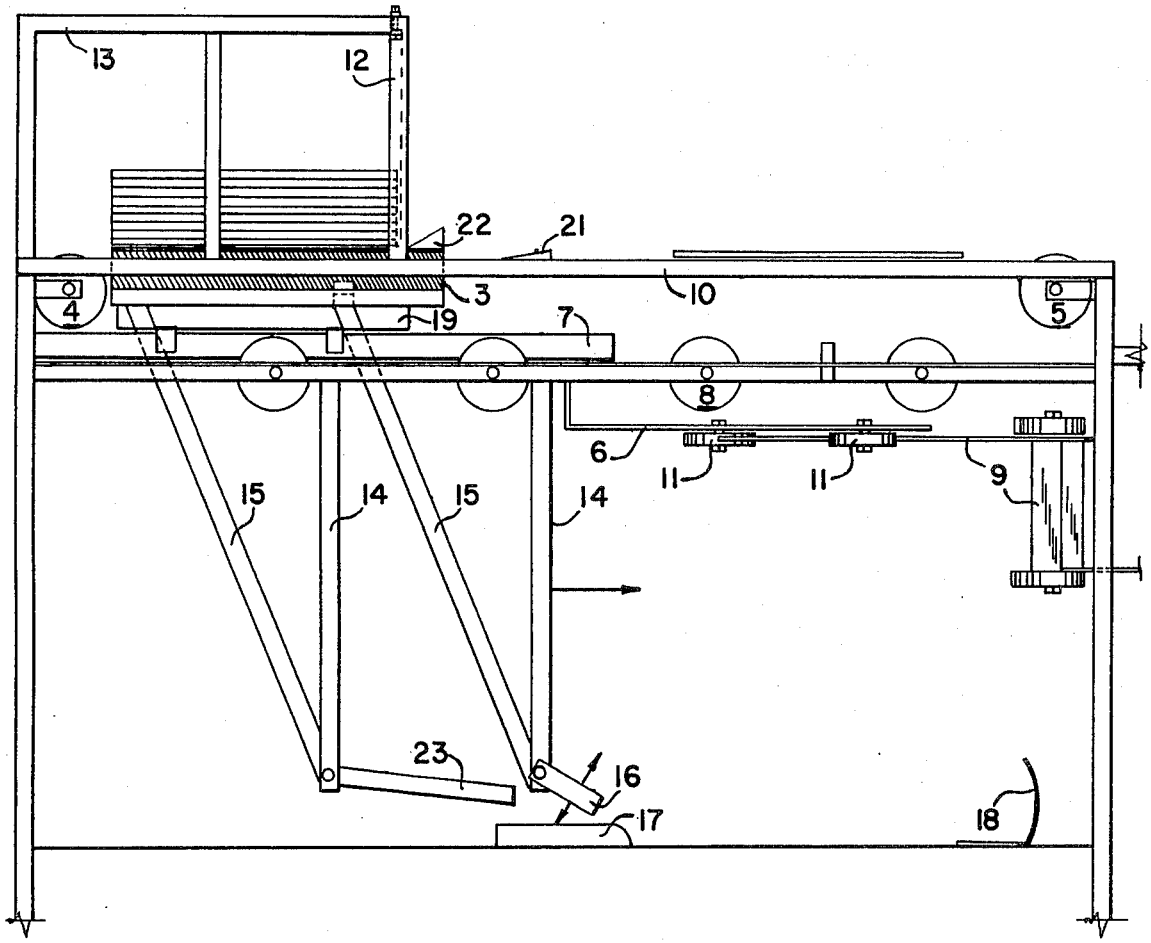
FIG. 3 is a side view of a complete separating unit.

Each separating unit 1 is like each of the others. As best seen in FIGS. 2 and 3, the top surface area of the unit has a number of steel strips 10 set on edge and running the length of the unit so that the insert materials rest on the narrow edges of strips 10 and can slide along the strips. Erected on the back one half of the separating unit as shown in FIG. 3 is a three-sided compartment 13. The front frame 12 of compartment 13 is adjustable vertically to define an aperture between the lower edge thereof and the strips 10. The back of compartment 13 is open so that a stack of material may be easily placed into the compartment.

Beneath the top surface area of the unit 10 is a pair of tracks 27 with wheels or rollers 8 fastened thereto and protruding above tracks 27. Tracks 27 are parallel to and extend the full length of the unit.

Riding on rollers 8 is the carriage 7. It is to be driven in a backward and forward manner. The carriage top 3 is mounted on levers 15 and which are fastened to the perpendicular carriage extensions 14. As the carriage 7 reaches one or the other end of the unit, it strikes rollers 4 and 5. By virtue of the levers, carriage 7 is forced either up or down and locked into position. Carriage 7 is forced up at the back end of the separating unit by roller 4, lifting the entire stack of material above the top level of the unit. The carriage 7 has a top surface 3 (See FIG. 2) which has frictional coefficient that is higher than that of the insert material, and is formed in strips so as to fit between the steel top strips 10 and can thereby be lifted between the strips 10 to a position higher than the top of the unit and locked into place by a blocking system 19.

Figure 4:
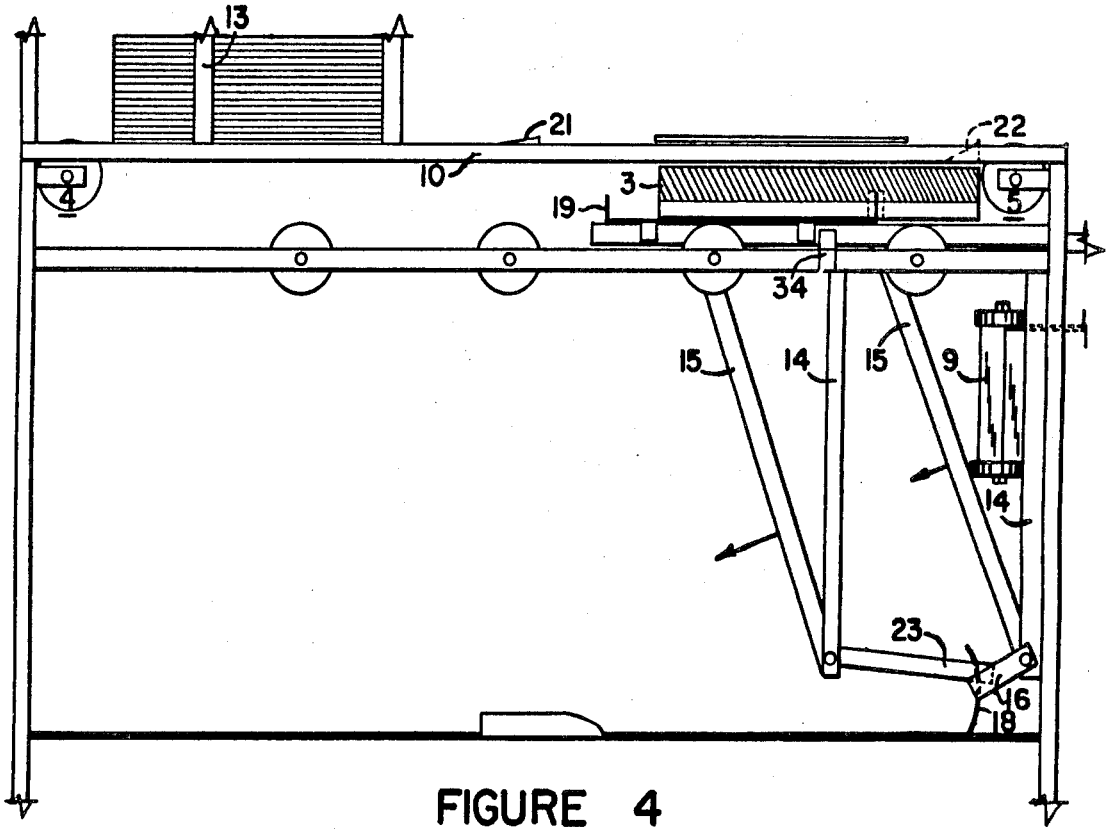
FIGS. 4 and 5 are side views of a separating unit showing movement of the separating unit carriage.
Figure 5:
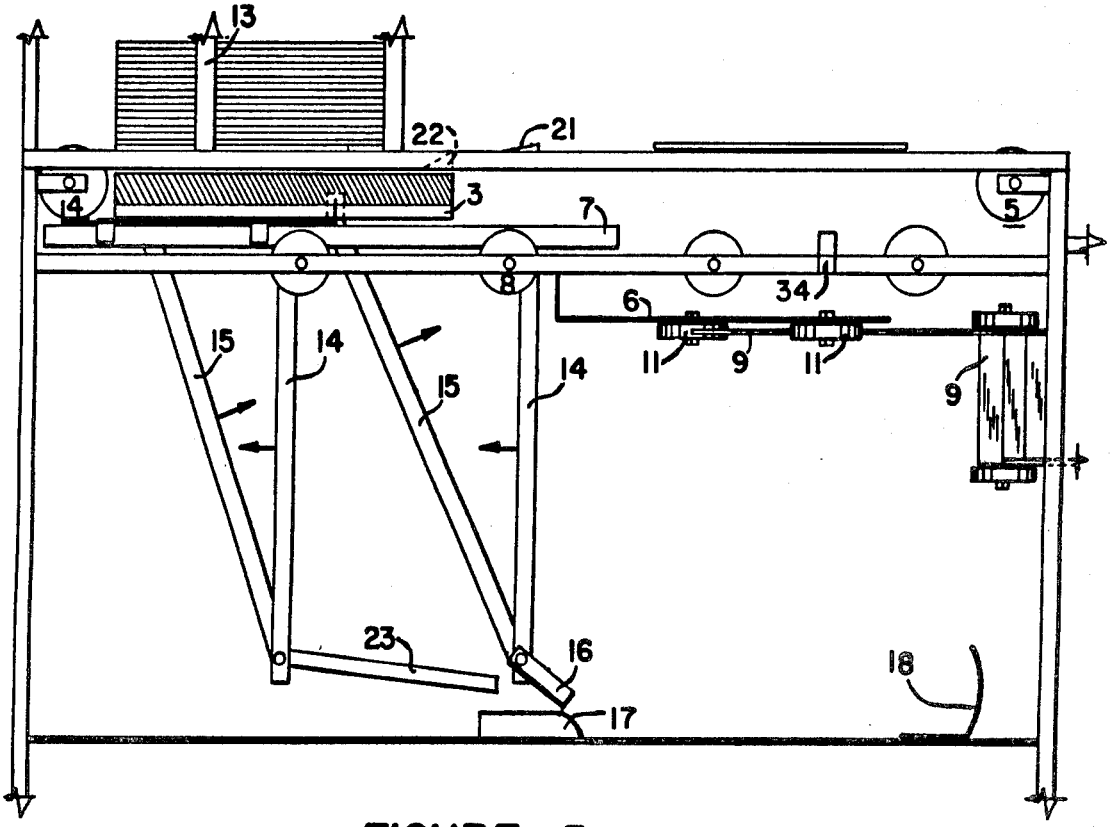

Referring now to FIGS. 4 and 5, movements of the elements of a separating unit 1 will be shown as indicated by arrows adjacent moving parts. As carriage 7 moves under the aperture formed by adjustable front frame 13 of the compartment 12, it carries with it the material which will move through the aperture. A properly adjusted front frame 12 will allow only one piece of material to pass thereunder at a time. The insert material carried by carriage 7 ratchets over ramp-shaped paper holder 21 as the material moves forward. As carriage 7 reaches the front of the separating unit 1 its lock 19 is released by virtue of striking a block 34 and is forced down below the surface of the unit 10 by roller 5 and locked into that position. The carriage 7 is locked in the down position by a stirrup 16 striking a stop 18 and being pushed under an extension of rear level arms 23. As carriage 7 moves rearward, stirrup 16 is no longer required, and is moved and held out of the way by block 17 as stirrup 16 is pulled thereacross as indicated by the arrows. Carriage 7 now leaves the separated piece of material resting in front of the stack and compartment 13 and can travel below the edge of strips 10 of the separating unit 1, under the stack of material to repeat the cycle. As the carriage 7 travels forward in a raised position, the leading edge thereof strikes the previously separated piece of material lying in front of the compartment 13 and pushes it into the inserting unit 2. This action is assisted by a pair of paper pushers 22 which continue to push while the rest of the carriage 7 is being forced down below the edge of strips 10 of the separating unit.

Figure 6:
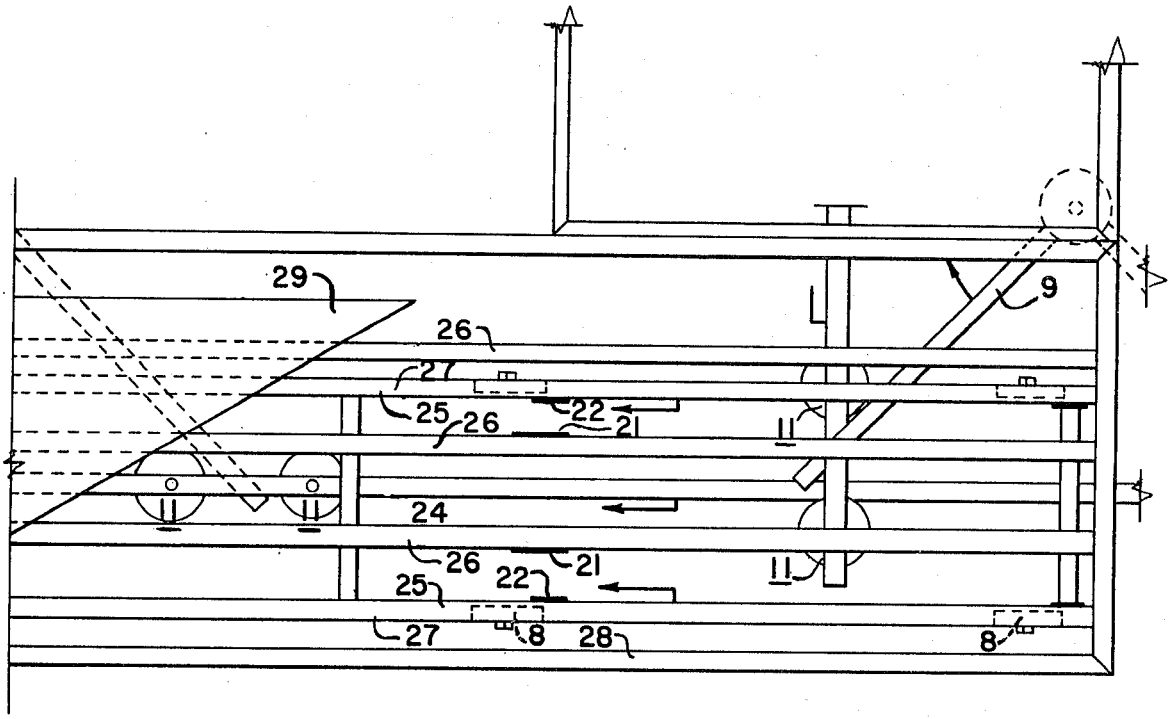
FIG. 6 is a top view of the portion of the inserting unit having a length equal to the width of the first separating unit and a following space.
Figure 7:
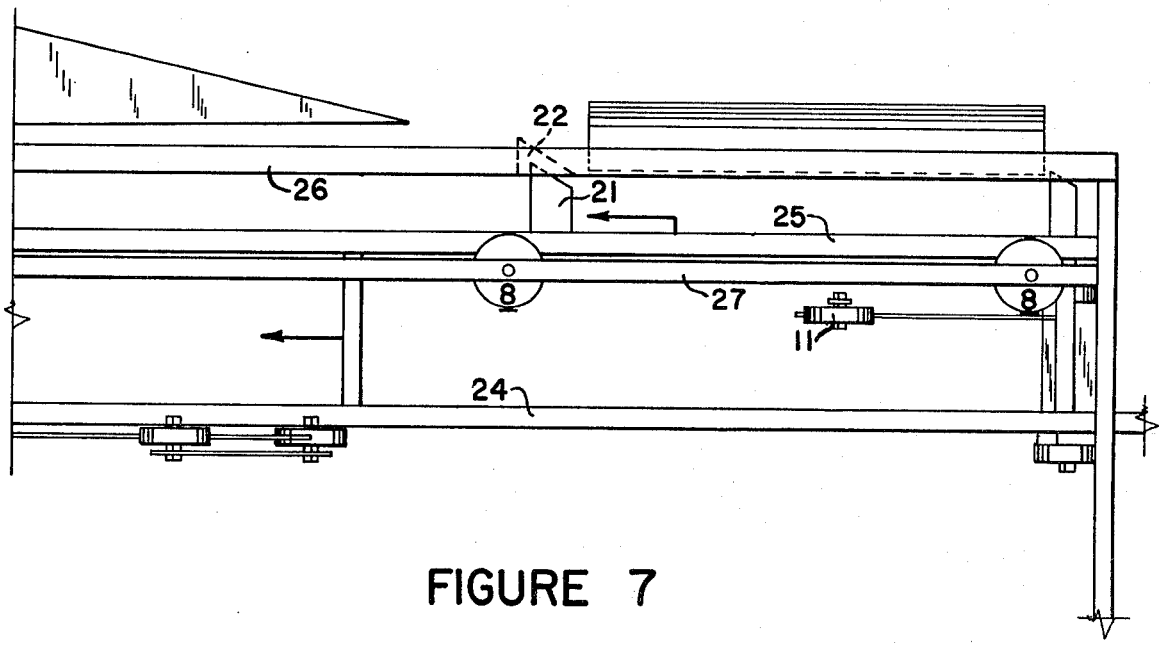
FIG. 7 is a side view of the portion of the inserting unit shown in FIG. 6.
Figure 8:
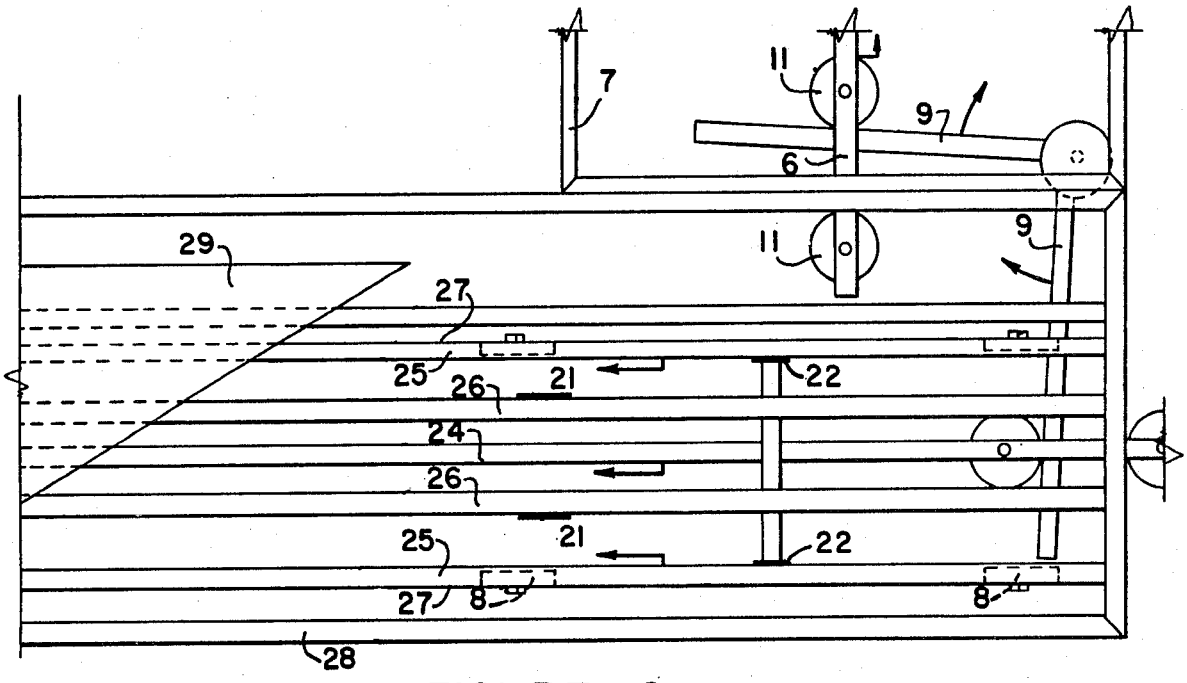
FIG. 8 is the same view as FIG. 6 showing movement of the parts.
Figure 9:
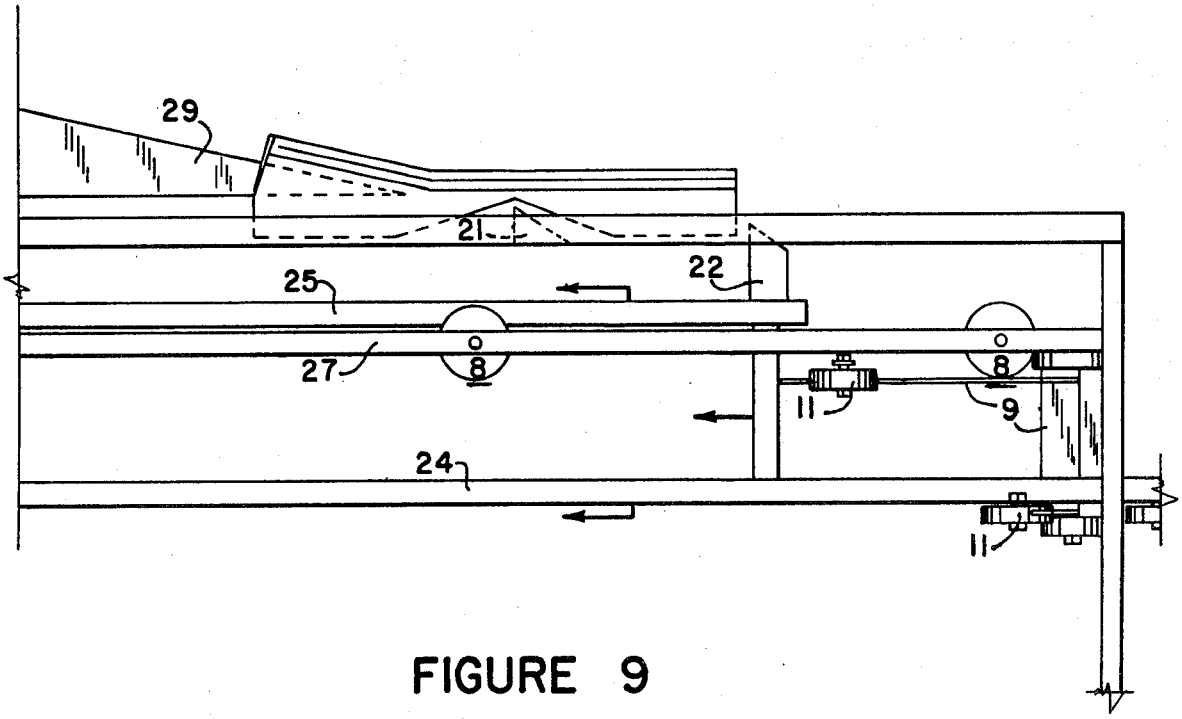
FIGS. 9 and 10 are the same view as FIG. 7 showing movement of the parts and paper.
Figure 10:
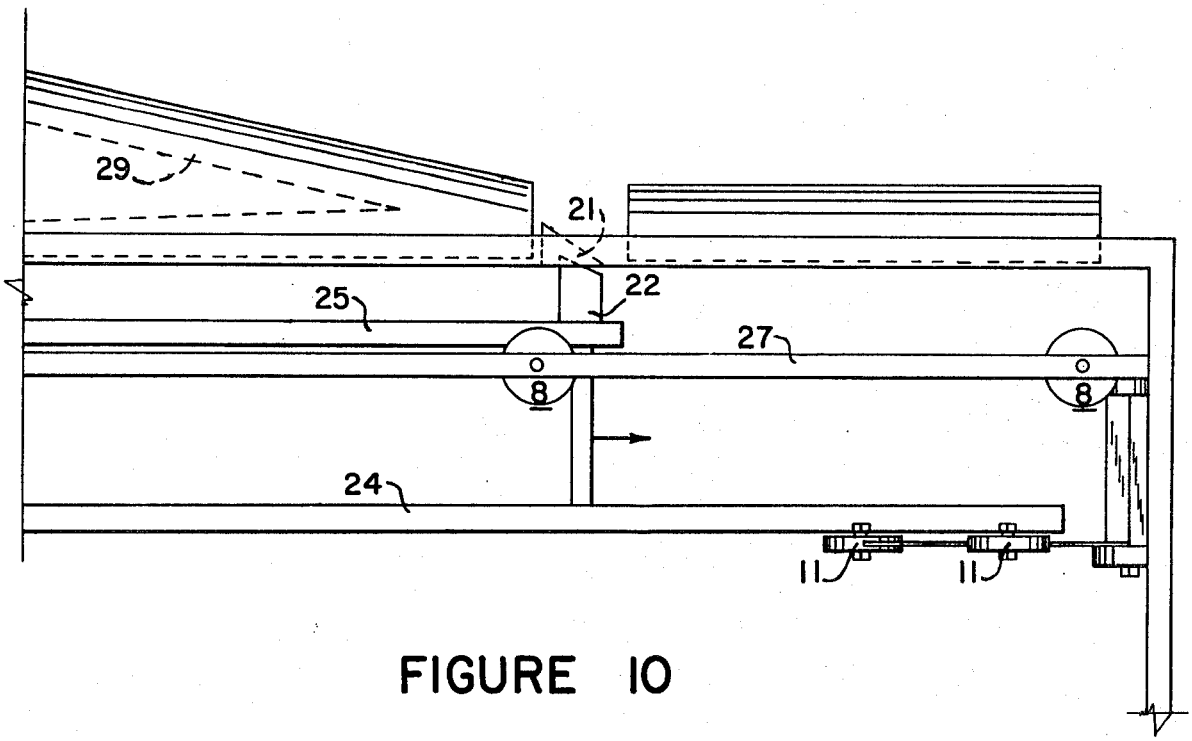

Details of the inserting unit 2 may be seen in FIGS. 6 and 7. A plurality of spaced apart top elements 26 of the inserting unit 2 run the length of the unit. As may be noted, the long dimension of inserting unit 2 is disposed at right angles to the separating units 1. As with the separating units 1, the inserting unit 2 has hanging below it, a pair of tracks 27 running the length thereof with rollers 8 fastened to and protruding above the tracks. Riding on these tracks and being moved therealong, is a frame 25. This frame is shorter than the inserting unit 2 by the width of one separating unit. Fastened to this frame 27 at intevals equal to one separating unit width are paper pushers 22 which extend upward through the top elements 26 of the inserting unit 2.

Fastened to the top of elements 26, directly in line with the sides of the separating units 1, are paper holders 21.

Above the surface of the inserting unit 21 the shapes of the paper holders 21 and paper pushers 22 are essentially the same. The work surfaces thereof are flat and perpendicular to the plane of the inserting unit 2. The back side of each is slanted to allow a piece of material to slide easily over the piece from the back, but to be held by the front of the piece 21 or 22.

As may be understood, the movable frame 25 of the paper pushers can be driven only the distance of the width of one separating unit. Referring to FIG. 1, assume that a jacket is in place in front of the right hand separating unit 1 holding a stack of jackets. As the frame 25 is driven to the left in FIGS. 6 and 7, in the direction of the arrows, it pushes the jacket in front of the next separating unit 1 over the slanted edges of holders 21. The material is held in place by the front of the holders 21 while the pushers 22 are driven back by frame 25 such that pushers 22 slide under the next piece of material in a ratchet fashion until the front of the pusher 22 is against the next piece, ready to reverse and push the material. The cycle is then repeated. As the jacket is pushed from in front of the first separating unit to rest in front of the space between the first and second separating units, it is also pushed into a blade opener 29 formed from a tapered piece of sheet steel. The blade opener 29 is fastened to vertical members between separating units 1 and the inserting unit 2. Opener 29 is higher than the top surfaces of inserting unit 2 and extends thereover the inserting unit 2. Opener 29 is adjustable and should be set to strike the jacket somewhere near the middle, thus opening the jacket. Opener 29 is extended in length to hold the jacket open for the rest of the length of the inserting unit 2 (see FIG. 1). The top area of the inserting unit 2, on the outside thereof, and parallel to the blade 29 has a vertical barrier 28 running the full length of the inserting unit 2. Barrier 28 keeps the material from falling or being pushed off of the inserting unit 2. As the jacket comes to rest in front of each separating unit 1, the bottom of the jacket is below the top surface of the separating unit 1 and the top is above. As the jacket rests in front of the separating unit 1, the insert is pushed from its separating unit surface onto the inserting unit 2 and into the jacket. In this manner, one of each insert is placed within the jacket. As the jacket is pushed from the end of the inserting unit 2, the jacket falls closed and the package is complete. The package may be collected at this point.

It should be noted that while the separating units 1 are working, the inserting unit 2 is resetting to pick up its next jacket. In continuous operation, carriage 7 is moving an insert to the front of its separating unit 1 simultaneously pushing an insert into a jacket disposed open directly in front thereof on frame 25. The jacket separating unit is moving a jacket from its compartment 12 in place on inserting unit 2 to be picked up by frame 25. These actions, coupled with the flat surface of the pushers 22 and holders 21, gives a neat package with the inserts straight and within the jacket, as desired.

The required coordination between inserting unit 2 and separating unit 1 is accomplished by driving the inserting unit 2 from a power source 30 and driving the separating units 1 from the inserting unit 2. The separating units 1 and inserting unit 2 are tied together by means of a right angle member 9 fastened at the corner of each separating unit/inserting unit 1, 2 junction.

Each of the two arms of the right angle member 9 has a roller 11 on each side thereof. As the right angle member 9 is moved, each of its arms will come against one of the roller 11 surfaces. Rollers 11 are fastened to extensions 6 and 24 which are fastened to the mechanisms they are to drive.

Figure 11:
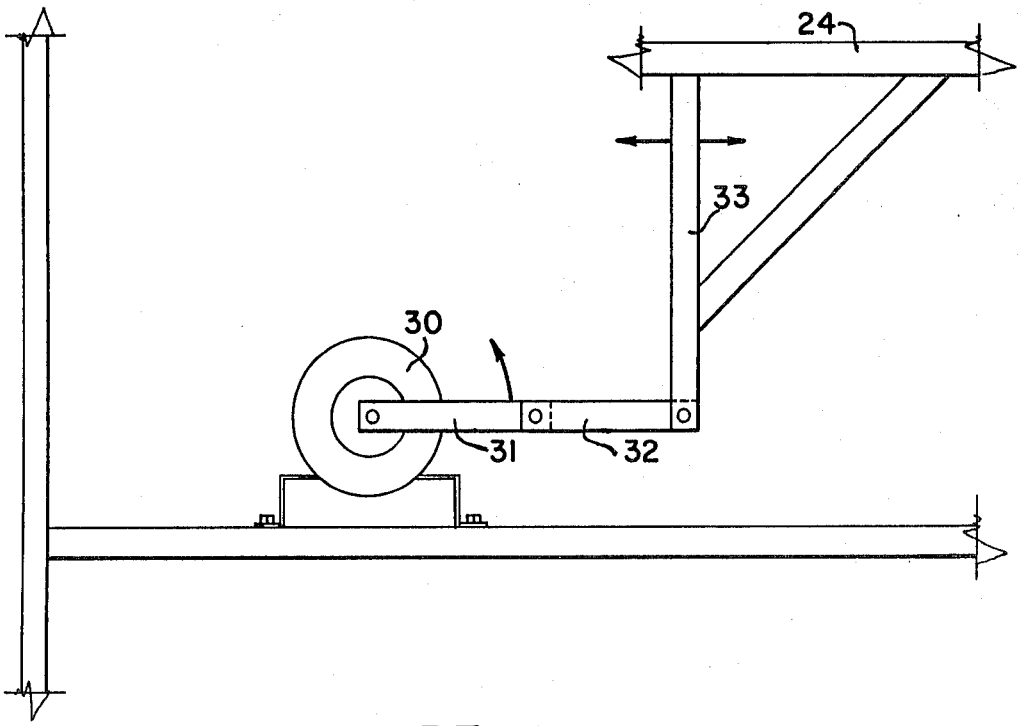
FIG. 11 is a front side view of a portion of the inserting unit showing the motor linked to the machine.

Bar 24, as seen in FIG. 11, which is fastened to the inserting unit frame 25, has a perpendicular extension 33 fastened thereto. Extension 33 has fastened to it and free to rotate around the point of fastening, an idler link 32. Idler link 32 is fastened to motor 30 by output link 31, and is free to rotate around this point of fastening also. In this case, the motor 30 may be of any type having a rotary output or any type of transmission or linkage fastened to a motor and having a rotary output.

As will now be recognized, a simple, low volume paper insertion apparatus has been disclosed. It is to be understood that the particular embodiment shown in the drawings is for the purpose of explanation and is not to be considered limiting. As will be apparent to those of skill in the art, various changes and modifications may be made without departing from the spirit and scope of the invention.

We claim:

1. An improved paper insert machine comprising a plurality of insert separating stations feeding an insert opening conveyor unit perpendicular to and lower than the separating stations an improvement comprising each separating station having:

a support frame;

a paper insert compartment disposed thereon;

openly spaced parallel paper guide strips extending from beneath the paper insert compartment to a distance beyond said insert opening conveyor unit;

said paper compartment having a side frame vertically movable above said guide strips to permit an adjustable insert opening;

a carriage mechanism suspended below the guide strips, said carriage mechanism having a lower drive portion connected by pivotable levers to an upper insert engaging portion and a movable locking means spaced between said portions and slidably relative to both;

a stationary pair of tracks having rollers located therealong and being suspended on said support frame parallel to and below said guide strips, said carriage drive portion resting upon said rollers, said upper carriage portion having a high friction insert engaging top surface formed of a series of openly spaced strips which fit between said guide strips, said movable locking means being slidable relative to said carriage portions between a first position causing said upper carriage portion when beneath insert compartment to pivot on said levers to a paper insert-engaging position wherein said frictional surfaces are above said guide strips and said carriage portions are relatively locked by said locking means and a second insert unloading position causing the surface of said upper carriage portion to lower below said guide strips as said locking means becomes unlocked and said insert conveyor unit whereby said insert rests upon said guide strips;

means adjacent said insert compartment and said insert opening conveyor unit to engage said carriage portions to permit said relative sliding of said locking means and drive means engaging the carriage drive portion to cycle said carriage between said insert engaging and unloading positions which causes the unloaded insert from the previous cycle to be pushed into said insert opening conveyor unit by the front of said carriage portion upon a repeat cycle.

2. Apparatus for placing an insert into a folded newspaper or the like comprising:

a first support frame having an input end and an output end;

a conveyor disposed on said support frame for moving a first folded newspaper from said input end in a first path along said support frame towards said output end;

a tapered blade opener disposed on said first path and positioned to enter a fold of said first newspaper so as to partially open the folds thereof as said conveyor traverses said first path, said conveyor adapted to stop at a preselected location along said first path and to deposit said partially opened newspaper thereat, said conveyor thereafter reversing its direction of motion to return to said input end of said first support frame for moving successive folded newspapers along said first path in a continuing cycle;

a second support frame having an input end, an output end, and a second path from said input end to said output end, said output end adjacent to said preselected location and said second path perpendicular to said first path;

an insert holding compartment disposed at said input end of said second support frame for holding a stack of paper inserts therein;

an insert carriage disposed on said second support frame for moving a first insert from the bottom of said stack along said second path for deposit at said output end of said second support, said carriage thereafter reversing its direction of motion to return to said input end of said second support frame for moving successive inserts from the bottom of said stack in a continuous cycle, said carriage including pushers for pushing a deposited insert from said second support frame into a stopped and opened newspaper at said preselected location along said first path, said conveyor thereafter pushing said inserted newspaper further along said first path free of said opener whereby said opened newspaper closes by gravity; and driving means coupled to said conveyor and said insert carriage for moving said conveyor and said insert carriage in synchronism with each other to thereby continuously place an insert into successive newspapers.

3. An apparatus for placing an insert into a folded newspaper according to claim 2 in which:

said second support frame supports a plurality of said insert holding compartments as defined therein;

a plurality of said insert carriages as defined therein; and a plurality of preselected locations along said first path, each adjacent to an output end of second paths for said plurality of insert carriages, whereby said conveyor deposits a partially opened newspaper at each of said locations.

4. An apparatus for placing an insert into a folded newspaper according to claim 2 in which:

said first support frame includes a plurality of spaced apart tracks; and said conveyor is a movable frame disposed on said tracks.

5. An apparatus for placing an insert into a folded newspaper according to claim 4 in which said tracks include a plurality of rollers, said conveyor riding on said rollers.

6. An apparatus for placing an insert into a folded newspaper according to claim 2 in which said conveyor includes a set of ratcheting paper pushers whereby movement of said conveyor in one direction pushes a newspaper therealong and movement in the other direction causes said paper pusher to move under the newspaper.

7. An apparatus for placing an insert into a folded newspaper according to claim 2 in which said second support frame icludes openly spaced parallel paper guide strips extending from said input end to said output end along said second path.

8. An apparatus for placing an insert into a folded newspaper according to claim 7 in which:

said holding compartment includes a vertically adjustable front frame having a lower edge defining an aperture through which a single insert can pass.

9. An apparatus for placing an insert into a folded newspaper according to claim 8 in which said carriage includes:

a plurality of open spaced strips forming a top surface thereof, said carriage strips adapted to fit between said guide strips and having a high friction insert engaging surface;

said carriage having a first position in which said carriage is raised with said top surface slightly above said guide strips for engaging the bottom one of the stack of paper inserts in said compartment, and a second position in which said carriage is lowered with said top surface slightly below said guide strips;

lever means attached to said carriage for raising said carriage to said first position when said carriage moves to said input end of said second support frame and for lowering said carriage to said second position when said carriage moves to said output end of said second support frame; and locking means for locking said carriage in said first position.

10. An apparatus for placing an insert into a folded newspaper according to claim 9 in which said carriage includes a set of ratcheting paper pushers for pushing said inserts when said carriage moves toward said output end and which move under said inserts when said carriage moves toward said input end.

11. An apparatus for placing an insert into a folded newspaper according to claim 2 in which:

said second path is defined by a top surface of said second support frame;

said first path is defined by a top surface of said first support frame wherein the level of said first path is below the level of said second path.

12. Apparatus for inserting paper inserts into folded newspaper jackets or the like comprising:

conveyor means for moving a jacket along a path and for depositing said jacket along said path;

opening means disposed along said path for partially opening said jacket to receive an insert;

compartment means for holding a stack of inserts;

separating means for removing an insert from the bottom of such a stack of inserts;

carriage means for moving an insert from said compartment means to a position adjacent said path; and pusher means associated with said carriage means for pushing an insert from said position into an opened jacket disposed in said path, said conveyor means then moving said opened and inserted jacket further along said path to be free of said opening means whereby said jacket closes by gravity.

* * * * *